US007032483B2

(12) United States Patent
Liu

(10) Patent No.: US 7,032,483 B2
(45) Date of Patent: Apr. 25, 2006

(54) TOOLBOX SCREWDRIVER

(76) Inventor: Kuo-Chen Liu, 235 Chung - Ho Box 8-24, Taipei (TW)

( * ) Notice: Subject to any disclaimer, the term of this patent is extended or adjusted under 35 U.S.C. 154(b) by 24 days.

(21) Appl. No.: 10/867,315

(22) Filed: Jun. 15, 2004

(65) Prior Publication Data

US 2005/0274240 A1 Dec. 15, 2005

(51) Int. Cl.
*B25G 1/08* (2006.01)
*A47B 95/02* (2006.01)

(52) U.S. Cl. ..... 81/490; 81/177.4; 81/439; 16/111.1

(58) Field of Classification Search ..... 81/490, 81/177.4, 439; 16/111.1, 430, 436, 438, 16/900
See application file for complete search history.

(56) References Cited

U.S. PATENT DOCUMENTS 4,204,294 A * 5/1980 Halverson ..... 15/185
4,669,617 A * 6/1987 Boeckmann et al. ..... 211/69.7
4,836,066 A * 6/1989 Graham et al. ..... 81/177.4
5,511,261 A * 4/1996 Collins ..... 7/158
5,522,291 A * 6/1996 Liu ..... 81/490
5,669,492 A * 9/1997 Chao ..... 206/234
D385,172 S * 10/1997 Bramsiepe et al. ..... D8/83
5,802,936 A * 9/1998 Liu ..... 81/450
5,887,306 A * 3/1999 Huang ..... 7/165
5,967,641 A * 10/1999 Sung et al. ..... 362/156
6,243,902 B1 * 6/2001 Huang ..... 7/165
6,405,865 B1 * 6/2002 Lin ..... 206/379
6,415,923 B1 * 7/2002 Chen ..... 206/379
6,751,819 B1 * 6/2004 Chuang ..... 7/100
6,877,186 B1 * 4/2005 Shiao ..... 16/111.1
6,915,900 B1 * 7/2005 Chen ..... 206/350
2002/0074254 A1 * 6/2002 Huang ..... 206/373

* cited by examiner

*Primary Examiner*—Lee D. Wilson
*Assistant Examiner*—Alvin J. Grant

(57) ABSTRACT

A toolbox screwdriver comprises a base, a first bracket and a second bracket. The first bracket and the second bracket are pivotally mounted on the base. The base has a plurality of projections, corresponding to a plurality of notches on the second bracket. The second bracket further includes a plurality of receptacle holes each for retaining a screwdriver head, which will be pushed upward by the projections as the first bracket is opened. The first bracket has a receptacle hole corresponding to an insertion hole on the base as the first bracket is retracted onto the base. The insertion hole of the base is for the insertion of a screwdriver rod, so that the toolbox can be used as a screwdriver.

8 Claims, 5 Drawing Sheets

TOOLBOX SCREWDRIVER

FIELD OF THE INVENTION

The present invention relates toolboxes capable of being a screwdriver, and more particularly to a toolbox screwdriver wherein various screwdriver heads can be stored therein and easily retrievable for replacement.

BACKGROUND OF THE INVENTION

Toolboxes capable of being a screwdriver of the prior art may have variations in structure. However, since the screwdriver heads contained by the conventional toolbox screwdrivers are exposed to the exterior, they would easily fall out of the toolbox, causing inconvenience to a user. To use such a toolbox screwdriver, the toolbox portion is used as a handle, and therefore all the screwdriver heads should be taken from the toolbox portion so that a user can hold the handle. After using the screwdriver, the screwdriver heads are then put back. This way not only wastes time but also has potential risk of losing screwdriver heads.

SUMMARY OF THE INVENTION

Accordingly, the primary objective of the present invention is to provide a toolbox screwdriver characterized in a first bracket pivotally mounted on a base thereof. The first bracket is provided with a receptacle hole for housing a screwdriver rod. The base is further provided with an insertion hole connected to and coaxial with the receptacle hole. Thereby, the receptacle hole is for storing the screwdriver rod, and the insertion hole is for mounting the screwdriver rod so that the toolbox can be used as a screwdriver. Since the receptacle hole and the insertion hole can respectively store and mount a screwdriver rod simultaneously, the storage space for such a toolbox is maximized.

The secondary objective of the present invention is to provide a toolbox screwdriver that further includes a second bracket for storing screwdriver heads. The maximum open angle of the second bracket is set to about 45 degrees, so that the screwdriver heads therein can be easily retrieved and the falloff of the screwdriver heads due to the second receptacle being opened too much can be prevented.

To achieve above object, the present invention provide a toolbox screwdriver which comprises: a base having a plurality of projections; a first bracket pivotally mounted on said base, said first bracket having a receptacle hole corresponding to an insertion hole on said base as said first bracket is retracted onto said base, said insertion hole of said base being for the insertion of a screwdriver rod. To achieve above object, the present invention provide a second bracket pivotally mounted on said base for storing screwdriver heads, said second bracket having a plurality of notches respectively corresponding to said projections whereby said screwdriver heads will be pushed upward by said projections as said first bracket is opened, said second bracket further including a plurality of receptacle holes each for retaining a screwdriver head.

The various objects and advantages of the present invention will be more readily understood from the following detailed description when read in conjunction with the appended drawings.

DETAILED DESCRIPTION OF THE PREFERRED EMBODIMENTS

Figure 1:
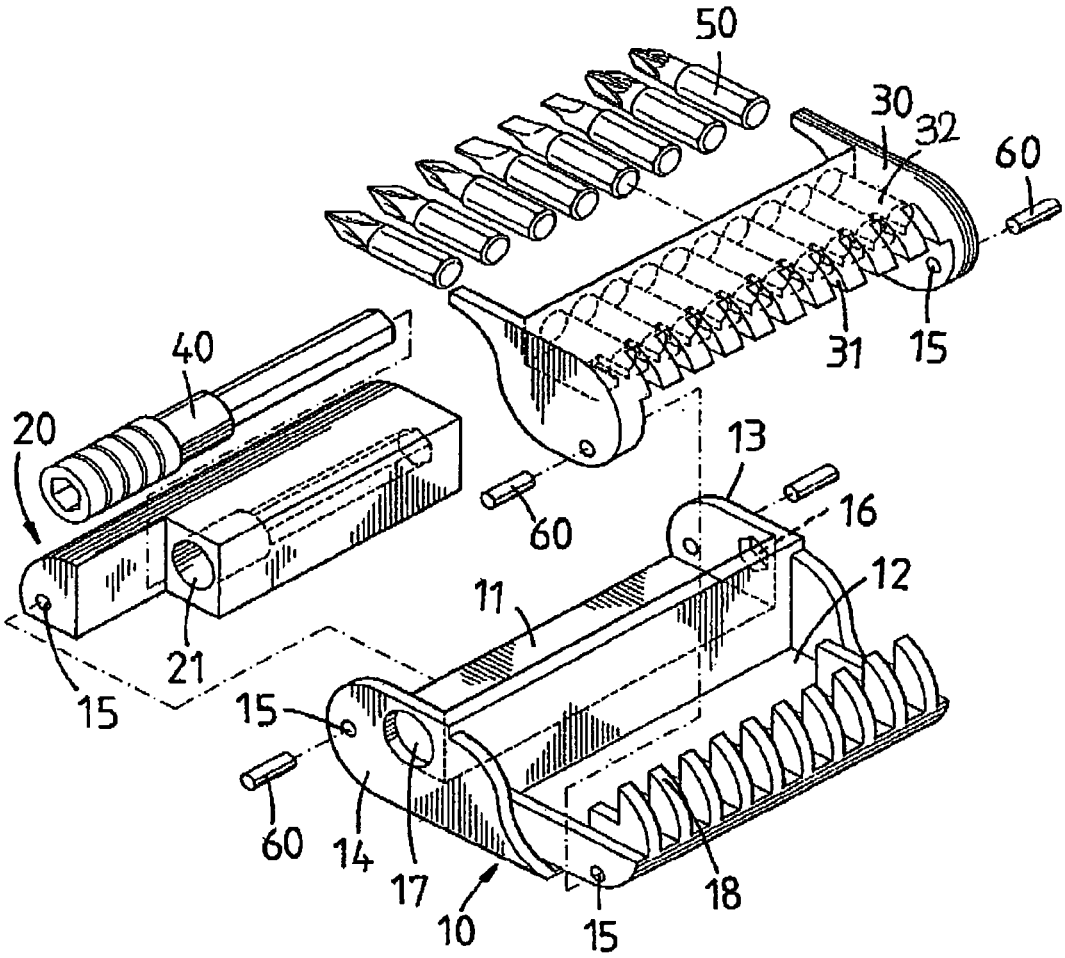
FIG. 1 is an exploded perspective view of a toolbox screwdriver according to the present invention.

Referring to FIG. 1, a toolbox screwdriver according to the present invention comprises a base 10, a first bracket 20 and a second bracket 30. The base 10 further comprises a first receptacle area 11 and a second receptacle area 12. Two lateral sides of the first receptacle area 11 are respectively provided with a first sidewall 13 and a second sidewall 14. Each of the sidewalls 13, 14 is provided with a pivot hole 15 for pivotally mounting the first bracket 20. The first sidewall 13 is further provided with an insertion hole 16 of hexagonal cross-section for the insertion of a screwdriver rod 40. The second sidewall 14 is further provided with a through hole 17 coaxial with the insertion hole 16. Two lateral sides of the second receptacle area 12 are each provided with a pivot hole 15 for pivotally mounting the second bracket 30. An end portion of the second receptacle area 12 is provided with a plurality of uniformly arranged projections 18. The rear side of the projections 18 takes an arc shape.

The first bracket 20 is provided with two pivot holes 15, each corresponding to a pivot hole 15 in the first receptacle area 11. The first bracket 20 further includes a receptacle hole 21 by the pivot holes 15 thereof. The axis of the receptacle hole 21 is parallel with the axial line connecting the pivot holes 15. Two ends of the receptacle hole 21 are respectively a round hole and a hexagonal hole for holding a screwdriver rod 40.

The second bracket 30 is for storing screwdriver heads. The bottom end of the second bracket 30 is provided with a plurality of uniformly spaced notches 31, each corresponding to a projection 18 of the second receptacle area 12. Above each of the notches 31, there is a receptacle hole 32 for housing a screwdriver head 50. Two sides of the second bracket 30 are each provided with a pivot hole 15 for pivotally mounting the second bracket 30 on the second receptacle area 12.

Figure 2:
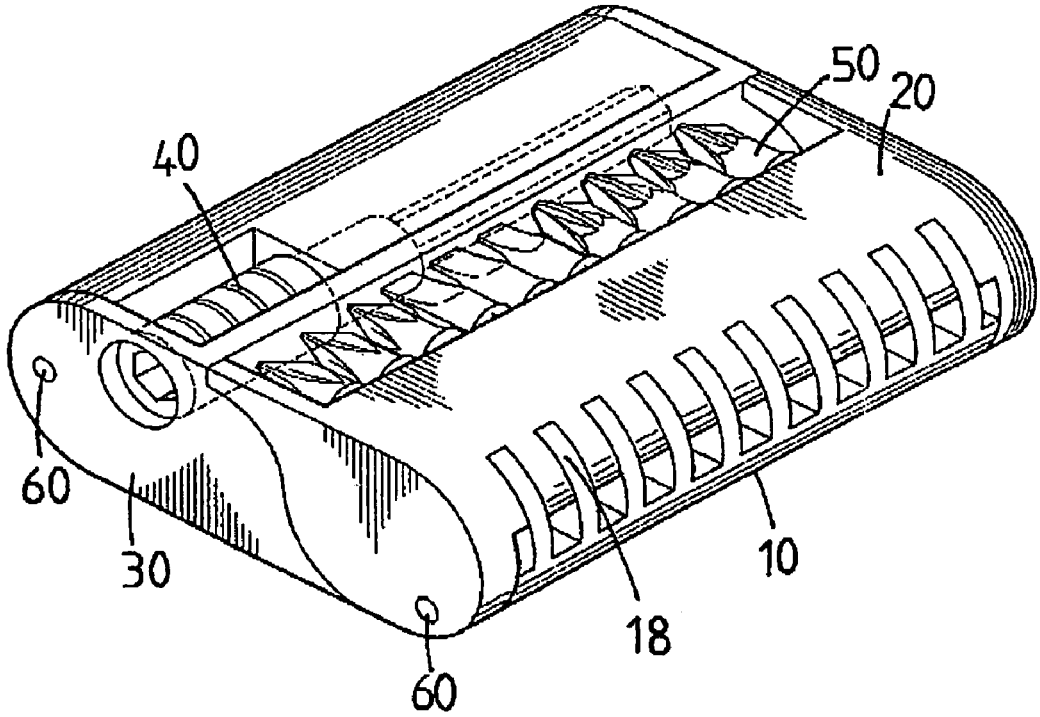
FIG. 2 is a perspective view of the toolbox screwdriver in FIG. 1.

Referring to FIG. 2, to assemble the toolbox screwdriver, the first bracket 20 and the second bracket 30 are pivotally mounted onto the first receptacle area 11 and the second receptacle area 12 respectively, using pivot pins 60. The screwdriver rod 40 can be retained within the receptacle hole 21 and the screwdriver heads 50 are disposed in the receptacle holes 32. After the toolbox screwdriver is closed, the arced arranged of the projections 18 makes the contour of the toolbox slick and beautiful.

Figure 3:
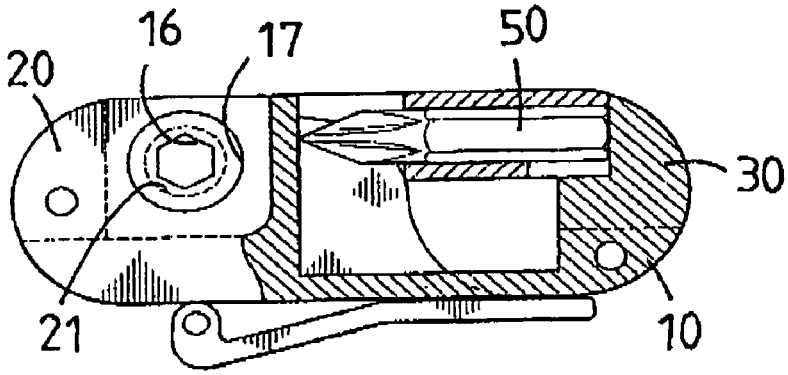
FIG. 3 illustrates a first configuration of the toolbox screwdriver in FIG 1.
Figure 4:
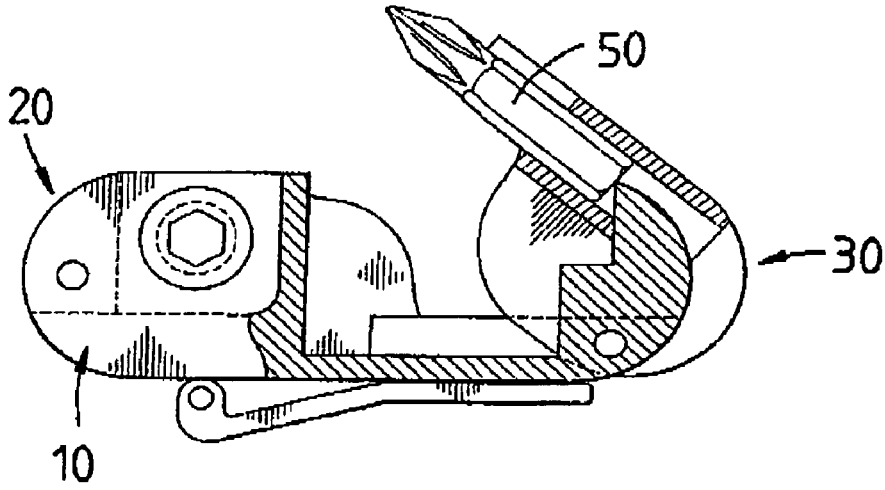
FIG. 4 illustrates a second configuration of the toolbox screwdriver in FIG. 1.

Referring to FIG. 3, the receptacle hole 21, the through hole 17 and the insertion hole 16 are coaxial. As shown in FIGS. 3 and 4, as the second bracket 30 is opened, the tilt angle of the second bracket 30 can be widened up to about 45 degrees, and the second bracket 30 then gets stuck because a flange of it is engaged with the projections 18. Such a tilt angle facilitates the retrieval of screwdriver heads 50 and prevents falloff of the screwdriver heads 50 due to the second bracket 30 being opened too wide. During the process of opening, the screwdriver heads 50 are gradually pushed upward by the projections 18, so that the retrieval is further facilitated.

Figure 5:
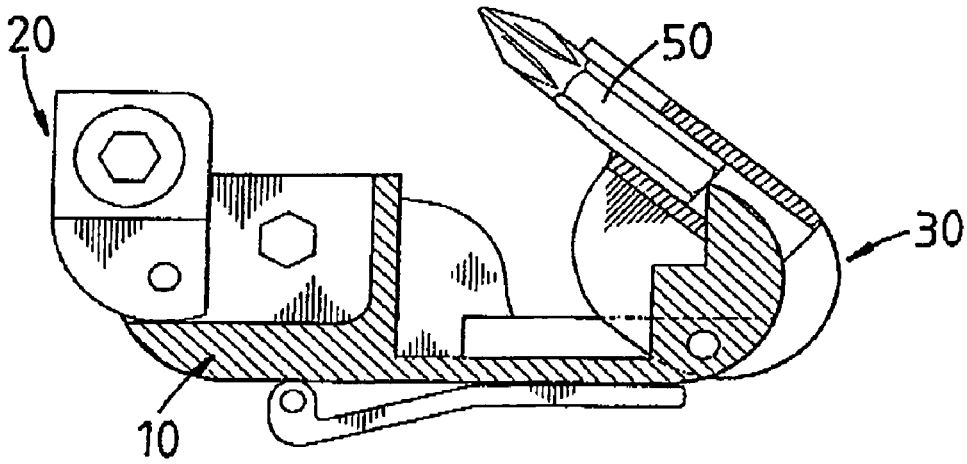
FIG. 5 illustrates a third configuration of the toolbox screwdriver in FIG. 1.
Figure 6:
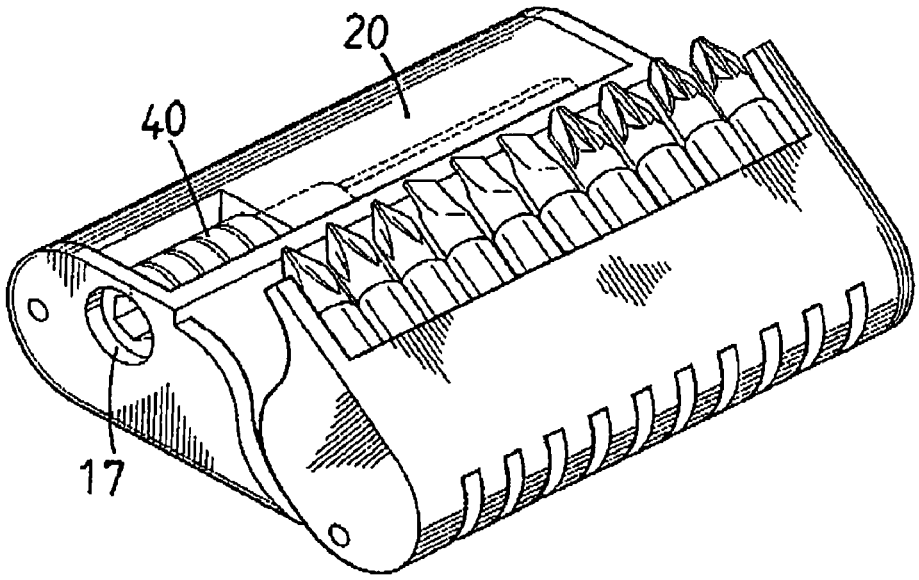
FIG. 6 is a perspective view of the toolbox screwdriver in FIG. 4.

FIGS. 4 and 5 shows the configurations of the first bracket 20 respectively in the open and the closed states. As shown in FIG. 6, when the first bracket 20 is retracted, the screwdriver rod 40 retained can be viewed through the through hole 17.

Figure 7:
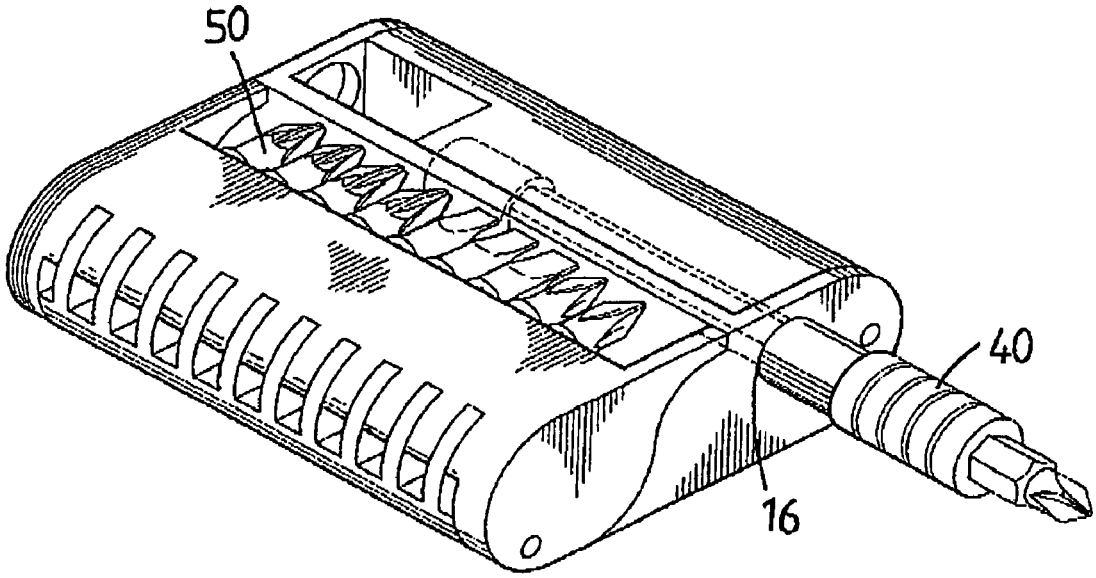
FIG. 7 illustrates a first usage configuration of the toolbox screwdriver.

Referring to FIG. 7, after the screwdriver rod 40 is taken out of the receptacle hole 21, it is inserted into the insertion hole 16. A screwdriver head 50 is then selected form the first bracket 20 and mounted on the tip of the screwdriver rod 40. Now the toolbox can be used as a screwdriver.

Figure 8:
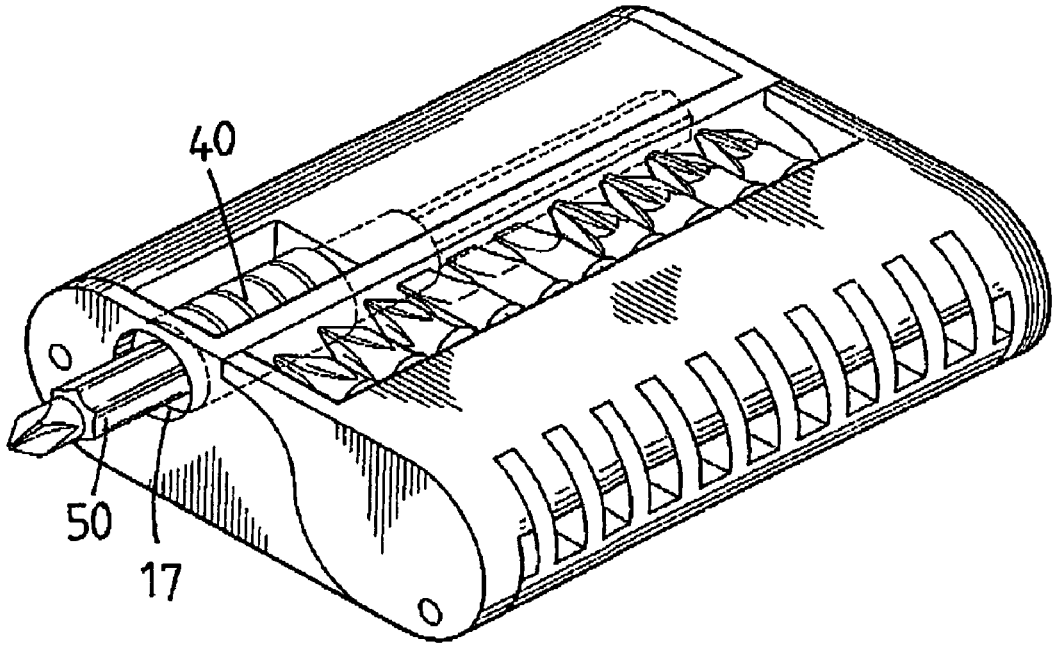
FIG. 8 illustrates a second usage configuration of the toolbox screwdriver.

Referring to FIG. 8, a toolbox according to the present invention is used as a handle, wherein a screwdriver head 50 is inserted in the through hole 17 and then connected to the screwdriver rod 40.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A toolbox screwdriver, comprising:

a base having a plurality of projections;

a first bracket pivotally mounted on said base, said first bracket having a receptacle hole corresponding to an insertion hole on said base as said first bracket is retracted onto said base, said insertion hole of said base being for the insertion of a screwdriver rod; and a second bracket pivotally mounted on said base for storing screwdriver heads, said second bracket having a plurality of notches respectively corresponding to said projections whereby said screwdriver heads will be pushed upward by said projections as said first bracket is opened, said second bracket further including a plurality of receptacle holes each for retaining a screwdriver head.

2. The toolbox screwdriver of claim 1 wherein two sides of said base are respectively provided with a first receptacle area and a second receptacle area for respectively mounting said first bracket and said second bracket.

3. The toolbox screwdriver of claim 1 wherein said base further includes a through hole disposed opposite to said receptacle hole and corresponding to another end of said insertion hole, for checking said screwdriver rod contained in said base, and wherein said through hole can be used to connect a screwdriver head onto said screwdriver rod retained in said base.

4. The toolbox screwdriver of claim 3 wherein said through hole, said receptacle hole and said insertion hole are coaxial.

5. The toolbox screwdriver of claim 1 wherein said base, said first bracket and said second bracket are provided with pivot holes for pivotally mounting together using pivot pins.

6. The toolbox screwdriver of claim 1 wherein a rear portion of said projections forms a arced shape, and wherein two lateral sides about said projections are provided with pivot holes for mounting said second bracket.

7. The toolbox screwdriver of claim 1 wherein said receptacle hole for retaining said screwdriver rod consists of a round hole and a hexagonal hole.

8. The toolbox screwdriver of claim 1 wherein the maximum open angle of said second bracket is substantially 45 degrees, as constrained by a flange of said receptacle hole being engaged with said projections.

* * * * *